United States Patent [19]

Windorski

[11] Patent Number: 4,993,590

[45] Date of Patent: Feb. 19, 1991

[54] SHEET DISPENSER

[75] Inventor: David C. Windorski, Woodbury, Minn.

[73] Assignee: Minnesota Mining and Manufacturing Company, Saint Paul, Minn.

[21] Appl. No.: 358,395

[22] Filed: May 26, 1989

[51] Int. Cl.[5] ..... B65H 1/04; B65H 1/00

[52] U.S. Cl. ..... 221/46; 221/45; 221/52

[58] Field of Search ..... 221/45, 46, 56, 58, 221/59, 63; 312/50

[56] References Cited

U.S. PATENT DOCUMENTS

| | | | |
|---|---|---|---|
| 442,214 | 12/1890 | Allen . | |
| 1,878,399 | 9/1932 | Hope | 221/59 |
| 2,464,426 | 3/1949 | Williams | 221/58 |
| 2,592,255 | 4/1952 | Dreers | 221/58 |
| 3,231,130 | 1/1966 | Foote | 221/131 |
| 3,310,199 | 3/1967 | Roberts et al. | 221/131 |
| 3,370,747 | 2/1968 | Desmond | 221/26 |
| 3,381,853 | 5/1968 | Ferris et al. | 221/63 |
| 3,425,595 | 2/1969 | Shapira | 221/52 |
| 4,191,306 | 3/1980 | Rabner | 221/33 |
| 4,416,392 | 11/1983 | Smith | 221/45 |
| 4,562,938 | 1/1986 | Loder | 221/46 |
| 4,586,629 | 5/1986 | Loder | 221/46 |
| 4,586,630 | 5/1986 | Loder | 221/46 |
| 4,653,666 | 3/1987 | Mertens | 221/45 |
| 4,674,634 | 6/1987 | Wilson | 221/45 |
| 4,768,810 | 4/1988 | Mertens | 282/12 |
| 4,770,320 | 9/1988 | Miles et al. | 221/46 |
| 4,781,306 | 11/1988 | Smith | 221/45 |
| 4,796,781 | 1/1989 | Windorski | 221/45 |

FOREIGN PATENT DOCUMENTS

| | | | |
|---|---|---|---|
| 1016522 | 11/1952 | France | 221/45 |

*Primary Examiner*—Andres Kashnikow
*Assistant Examiner*—Lesley D. Morris
*Attorney, Agent, or Firm*—Donald W. Sell; Walter N. Kirn; William L. Huebsch

[57] ABSTRACT

A dispenser for a stack of partially adhesive coated sheets stacked with the adhesive coating on each successive sheet disposed along alternate opposite sides of the stack and releasbly adhering the sheets together. The dispenser has a cavity adapted to receive the stack defined by surfaces including opposed upwardly diverging end surfaces spaced apart to arc the stack positioned with its sides against the end surfaces and to position a top surface of the stack along arcuate upper inner friction surface portions of the dispenser with an end portion of the uppermost sheet in the stack projecting through an opening between those inner surface portions. The uppermost sheet on the stack can be manually withdrawn through the opening and will carry with it the end portion of the sheet beneath it in the stack, the opposed upwardly diverging end surfaces between which the stack is arched will cause movement of the sides of the stack along the end surfaces toward the upper surface portions of the stack in response to forces applied to the stack of sequentially remove sheets from the stack through the opening, and the friction surface portions will insure that only one sheet is pulled from the dispenser at one time.

14 Claims, 2 Drawing Sheets

SHEET DISPENSER

TECHNICAL FIELD

The present invention relates to dispensers for sheets from a stack of flexible sheet material comprising a plurality of the sheets disposed one on top of another, each sheet having a band of pressure sensitive adhesive coated on one surface adjacent one edge thereof and being free of adhesive coating adjacent an opposite edge thereof, and the sheets being stacked with the adhesive coating on each successive sheet disposed along alternate opposite sides of the stack and releasably adhering the sheets together to maintain the sheets in the stack.

BACKGROUND ART

Dispensers are known for sheets from a stack of flexible sheet material comprising a plurality of the sheets disposed one on top of another, each sheet having a band of pressure sensitive adhesive coated on one surface adjacent one edge thereof and being free of adhesive coating adjacent an opposite edge thereof, and the sheets being stacked with the adhesive coating on each successive sheet disposed along alternate opposite sides of the stack and releasably adhering the sheets together to maintain the sheets in the stack. U.S. Pat. Nos. 4,416,392 and 4,796,781 describe such dispensers, each of which include means for positioning a top surface of the stack along a surface of the dispenser with an end portion of the uppermost sheet in the stack projecting through a central opening through that surface so that the uppermost sheet on the stack can be manually withdrawn through the opening and will carry with it the end portion of the sheet beneath it in the stack which then projects through the opening in a position that it too may be withdrawn. In the dispenser described in U.S. Pat. No. 4,416,392 that means is a spring on the side of the stack opposite its top surface, and in the dispenser described in U.S. Pat. No. 4,796,781 that means is a weighted portion of the dispenser providing the central opening that is movable relative to a base portion of the dispenser on which the stack is supported. While both of these dispensers are useful and efficient for dispensing sheet from such a stack, both are more complex and expensive than may be desired for certain applications.

DISCLOSURE OF INVENTION

The present invention provides a simple, inexpensive and effective dispenser for dispensing flexible sheets from a stack comprising a plurality of the sheets disposed one on top of another, each sheet having a band of pressure sensitive adhesive coated on one surface adjacent one edge thereof and being free of adhesive coating along a portion adjacent an opposite edge thereof, and the sheets being stacked with the adhesive coating on each successive sheet disposed along alternate opposite sides of the stack and releasably adhering the sheets together to maintain the sheets in the stack.

The dispenser according to the present invention comprises walls having surfaces defining a cavity adapted to receive the stack, the surfaces including (1) opposed end surfaces having parallel upper ends adapted to be engaged by the opposite sides of the stack with the top sheets in the stack parallel to and adjacent the upper ends, (2) friction surface portions extending toward each other from the upper ends of the end surfaces and having spaced distal ends, and (3) opposed outlet surfaces at the distal ends of the arcuate surface portions defining an opening through the walls between the distal ends of the arcuate surface portions. The opposed end surfaces are spaced apart a distance less than the distance between the opposite sides of the stack to arc the stack positioned with its sides against the end surfaces and to position the uppermost sheets of the stack along the friction surface portions with the adhesive free portion of the uppermost sheet in the stack projecting through the opening. By grasping that end portion the uppermost sheet on the stack can be manually pulled through the opening and will carry with it the adhesive free end portion of the sheet beneath it in the stack to which the uppermost sheet is adhered by the adhesive coating on the uppermost sheet, placing that adhesive free end portion in a position where it also may be grasped and pulled to withdraw the next sheet from the stack. The opposed end surfaces against which sides of the stack are engaged to arc the stack diverge slightly from each other toward the upper ends of the end surfaces to cause movement of the sides of the stack along the end surfaces toward their upper ends and the arcuate surface portions in response to forces applied to the stack to sequentially remove sheets from the stack through the opening. The friction surface portions are shaped to provide means for affording sliding movement of the adhesively joined end portions of the uppermost sheet and the sheet beneath it between the rest of the stack and the adjacent friction surface portion, and for making sufficient frictional engagement with the adhesive coated end portion of the sheet beneath the uppermost sheet to restrict its movement between the stack and the adjacent friction surface portion to thereby afford pealing separation between the uppermost sheet and the sheet beneath it after the uppermost sheet is withdrawn from the dispenser.

Preferably the opposed end surfaces diverge from each other toward their upper ends at an angle in the range of about 6 to 18 degrees and preferably of about 12 degrees; and the friction portions are preferably generally arcuate or cylindrical and concave, have an axis parallel to said upper ends, and extend toward each other along an aligned arcuate path from the upper ends of the end surfaces.

Also, preferably the walls of the dispenser are included in a unitary structure such as a polymeric molding, the surfaces further include a cylindrically convex bottom surface opposed to and generally uniformly spaced from the generally arcuate concave surface portions and extending between the ends of the opposed end surfaces opposite their upper ends; and the opposed end surfaces, the concave arcuate surface portions, the opposed outlet surfaces, and the bottom surface extend transversely entirely through the dispenser so that said cavity has opposite end openings through which the stack can be insertable into the cavity. Such a dispenser can have a transverse width less or greater than the width of the stack from which it dispenses sheets; and can have a width adapted to dispense sheets from more than one stack, such as from stacks of different width sheets.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
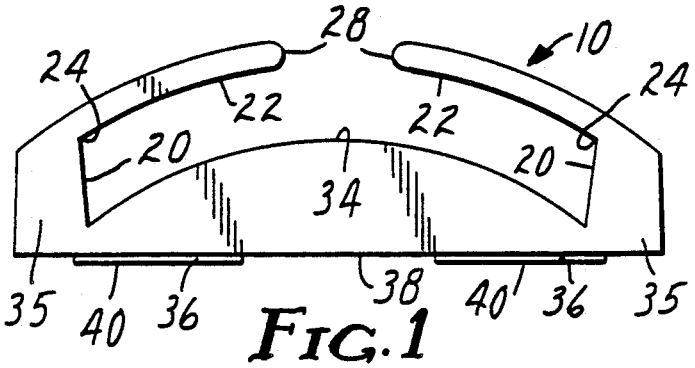
FIG. 1 is a side view of a first embodiment of a sheet dispenser according to the present invention.
Figure 2:
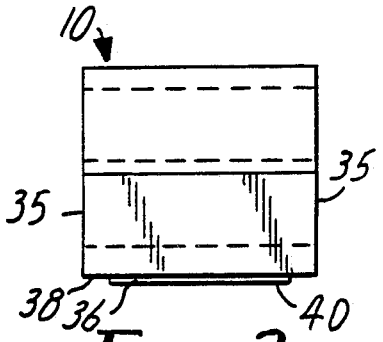
FIG. 2 is an end view of the sheet dispenser shown in FIG. 1.

Referring now to FIGS. 1 through 5 of the drawing, there is shown a dispenser according to the present invention generally designated by the reference numeral 10.

The dispenser 10 is for dispensing flexible sheets 12 from a stack 14 comprising a plurality of the sheets 12 disposed one on top of another, each sheet 12 having a band of pressure sensitive adhesive coated on a minor portion of one surface adjacent one edge thereof and being free of adhesive coating on a major portion of that surface adjacent an opposite edge thereof, and the sheets 12 being stacked with the adhesive coating on each successive sheet 12 disposed along alternate opposite sides 16 of the stack 14 and releasably adhering the sheets 12 together to maintain the sheets 12 in the stack 14. (e.g., the stack of sheets described in U.S. Pat. No. 4,416,392, the content whereof is incorporated herein by reference).

The dispenser 10 comprises walls having surfaces defining a cavity adapted to receive the stack 14. Those surfaces include opposed planar end surfaces 20 having parallel upper ends 24, which end surfaces 20 are adapted to be engaged by the opposite sides 16 of the stack 14 and are spaced to cause the stack 14 positioned therebetween to be arched; and arcuate concave friction surface portions 22 that have proximal ends at the upper ends 24 of the end surfaces 20, extend toward each other along an aligned arcuate path from the upper ends 24 of the end surfaces 20 and have spaced distal ends (e.g. spaced by about 1.5 centimeter). Opposed outlet surfaces 28 at the spaced distal ends of the arcuate surface portions 22 define an opening through the walls of the dispenser 10 between the distal ends of the arcuate surface portions 22. As illustrated, the friction surface portions 22 are cylindrically concave about an axis, but alternatively the friction surface portions could have portions about different radii, or be formed by straight portions or a combination of straight or arcuate portions provided the overall effect is to provide a friction surface that generally conforms to the upper arcuate surface of the stack positioned between the end surfaces 24 and provides the function described below during dispensing of sheets 12 from the dispenser 10.

The opposed end surfaces 20 are spaced apart a distance less that the distance between the opposite sides 16 of the stack 10 (e.g., spaced at about 7.39 centimeters (2.91 inches) between the upper ends 24 of the end surfaces 20 for a stack 7.62 centimeter (3 inches) wide between its sides 16) to arc the stack 10 positioned with its sides 16 against the end surfaces 20 and to position the upper most sheets 12 of the stack 10 along the generally arcuate friction surface portions 22 with the adhesive free end portion of the uppermost sheet 12 in the stack 14 projecting through the opening. By grasping that end portion the uppermost sheet 12 of the stack 14 can be manually pulled through the opening and will carry with it the adhesive free end portion of the sheet 12 beneath it in the stack 14, placing that end portion in a position where it also may be grasped and pulled to withdraw the next sheet 12 from the stack 14 through the opening.

Figure 3:
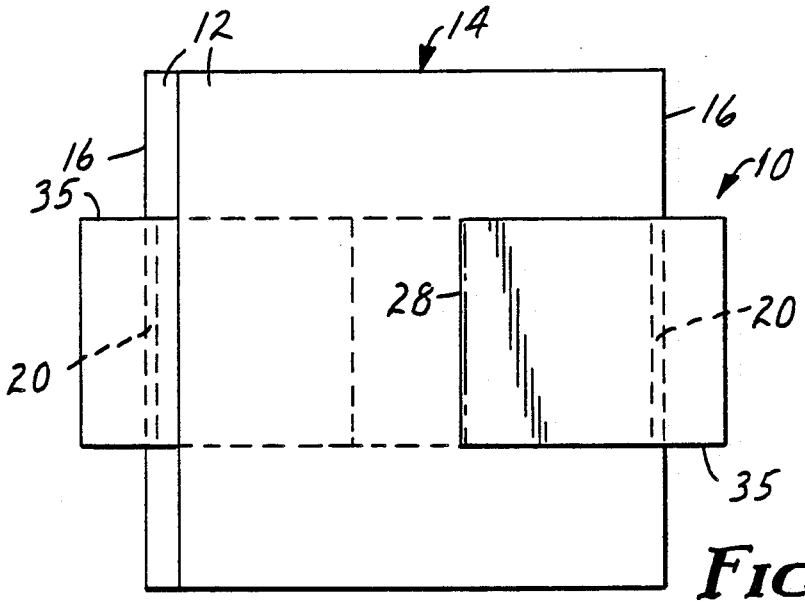
FIG. 3 is a top view of the sheet dispenser of FIG. 1 having a stack of sheets positioned therein.
Figure 4:
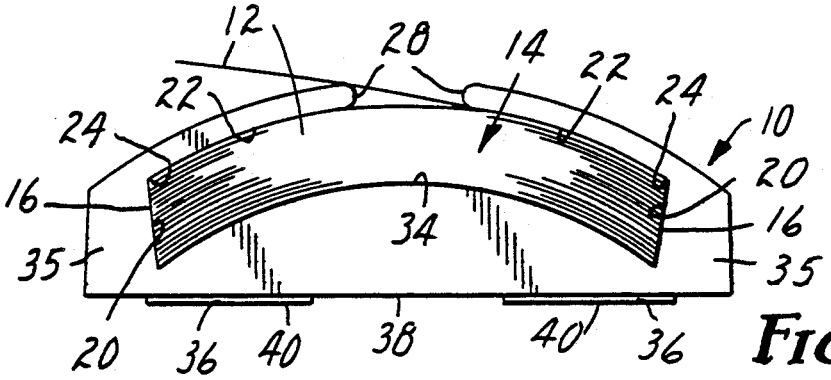
FIG. 4 is a side view of the sheet dispenser as shown in FIG. 3.
Figure 5:
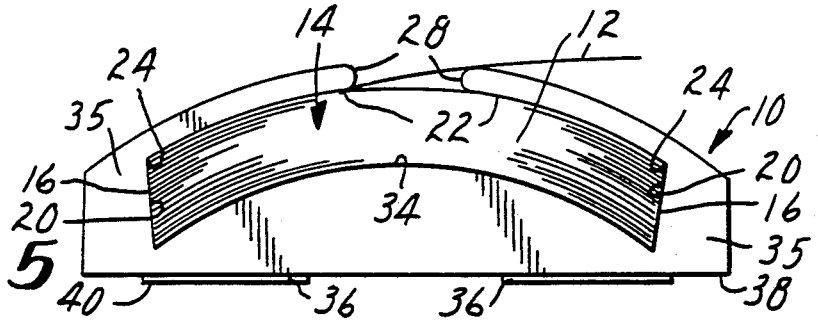
FIG. 5 is a side view of the sheet dispenser as shown in FIG. 4 from which a large number of the sheets in the stack have been dispensed.

The opposed end surfaces 20 against which sides 16 of the stack 14 are engaged diverge slightly from each other toward the upper ends 24 of the end surfaces 20 to cause movement of the sides 16 of the stack 14 along the end surfaces 20 toward their upper ends 24 and the arcuate friction surface portions 22 in response to forces applied to the stack 14 to sequentially remove sheets 12 from the stack 14 through the opening (see FIGS. 3, 4 and 5). To cause such movement of the stack 14, the opposed end surfaces 20 should diverge from each other toward their upper ends 24 at an angle in the range of about 6 to 18 degrees, and preferably at an angle of about 12 degrees. The use of a bottom sheet on the stack 14 that is more stiff than the other sheets 12 in the stack was found to insure movement of the last few sheets 12 in the stack to positions adjacent the upper ends 24 of the end surfaces 20 so that those last few sheets will be dispensed one at a time rather than as a chain of sheets.

Figure 6:
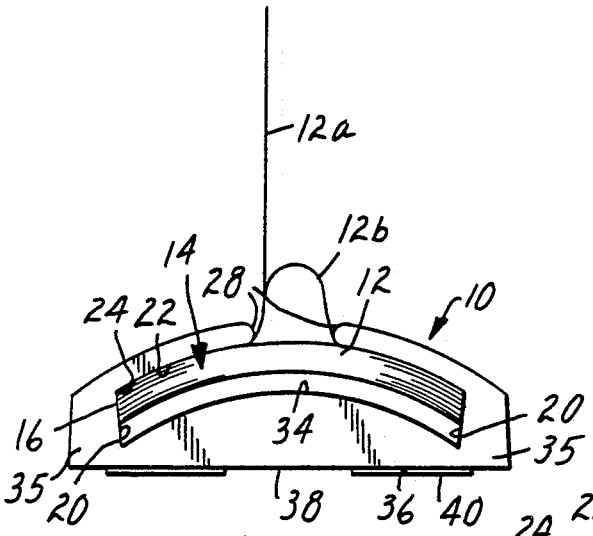
FIGS. 6 and 7 sequentially illustrate the movement of an uppermost sheet and a sheet beneath it in the stack as the uppermost sheet is withdrawn from the dispenser as illustrated in FIG. 5.
Figure 7:
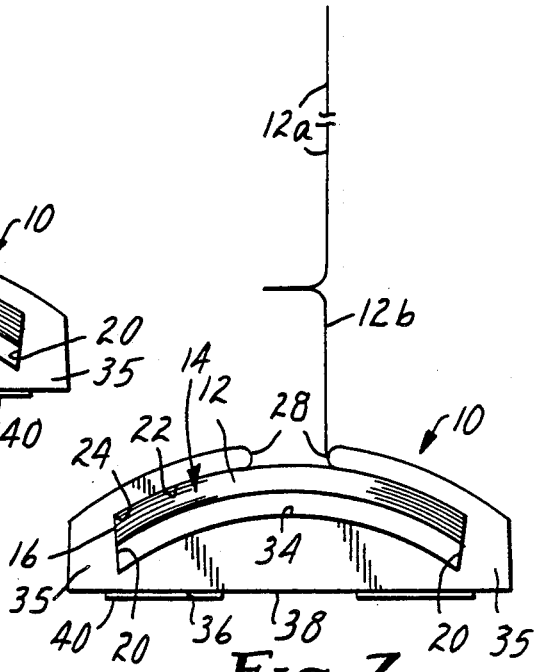

The friction surface portions 22 are shaped to provide means for affording sliding movement of the adhesively joined end portions of the uppermost sheet 12*a* and the sheet 12*b* beneath it between the rest of the stack 14 and the adjacent friction surface portion 22 as is illustrated in FIG. 6, and for making sufficient frictional engagement with the adhesive coated end portion of the sheet 12 beneath the uppermost sheet 12 to restrict its movement between the rest of the stack 14 and the adjacent friction surface portion 22 to thereby afford pealing separation between the uppermost sheet 12 and the sheet 12 beneath it after the uppermost sheet 12 is withdrawn from the dispenser as is illustrated in FIG. 7.

The walls of the dispenser 10 are included in a unitary structure (e.g., a polymeric molding of polystyrene, or a metal casting or length of an extrusion), and the surfaces further include a bottom surface 34 extending between the ends of the opposed end surfaces 20 opposite their upper ends 24, which bottom surface 34 could be planar between those ends but as illustrated is cylindrically convex about the axis of the arcuate surface portions 22 and is opposed to and generally uniformly spaced from the cylindrically concave arcuate surface portions 22 by a distance slightly more than the thickness dimension of the stack 14 the dispenser 10 is adapted to receive (e.g., 1.5 centimeter). The opposed end surfaces 20, the concave arcuate surface portions 22, the opposed outlet surfaces 28, and the convex bottom surface 34 extend transversely entirely through the dispenser 10 parallel to the axis of the surface portions 22 and bottom surface 34 so that the cavity defined by those surfaces has opposite end openings opening through sides 35 of the dispenser 10, through which end openings the stack 14 can be insertable into the cavity. The dispenser 10 as illustrated can thus have a transverse width less than the width of the stack 14 from which it dispenses sheets (e.g., a width of 3.3 centimeters for a stack having a width parallel to its sides 16 of about 7.62 centimeters).

Means in the form of rectangular foam pads 36 adhered to a base surface 38 of the dispenser 10 and having a coating of pressure sensitive adhesive on their surfaces opposite the base surface 38 that may prior to use be covered with a release liner 40 are provided for adhesively anchoring the dispenser 10 to a substrate. Alternatively, the dispenser 10 could be anchored to a substrate by mechanical means, such as screws, or be made of or filled with a material of sufficient weight that the dispenser would stay in place with its base surface 38 against a horizontal surface while a sheet 12 is withdrawn from it. The dispenser is also useful without such anchoring means, but typically then requires holding the dispenser 10 in one hand while a sheet 12 is withdrawn by the other.

Figure 8:
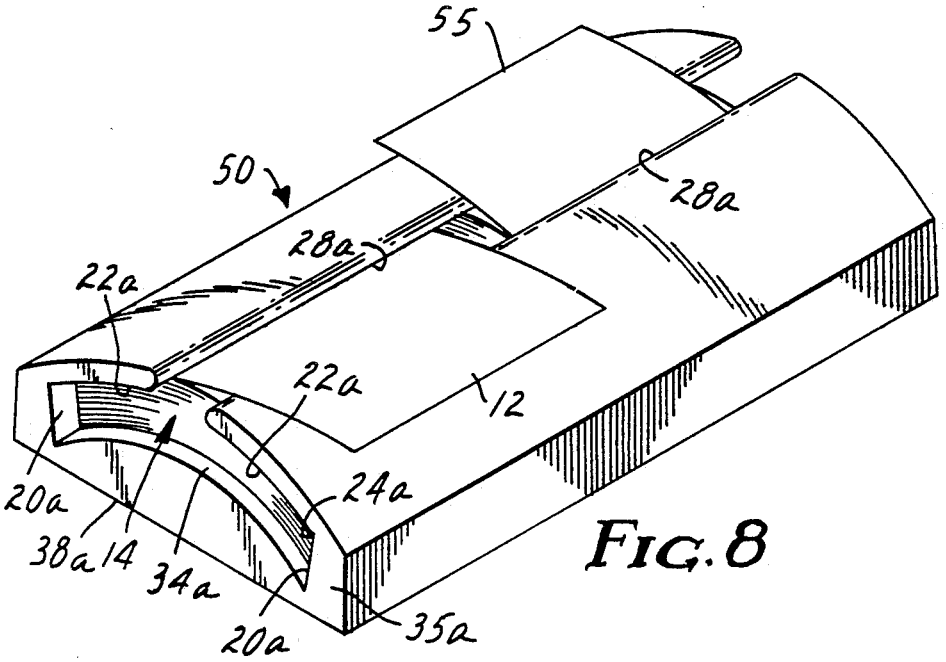
FIG. 8 is a top view of a second embodiment of a sheet dispenser according to the present invention having two stacks of sheets positioned therein.

FIG. 8 illustrates an alternate embodiment of a dispenser according to the present invention, generally designated by the reference numeral 50. The dispenser 50 has the same cross sectional shape as the dispenser 10, and has all its parts and surfaces indicated by the same reference numerals used with reference to the dispenser 10 except for the addition of the suffix "a". The dispenser 50 has a much greater transverse length between its end surfaces 35*a* so that the cavity defined in the dispenser 50 by the opposed upwardly diverging end surfaces 20*a*, the concave arcuate surface portions 22*a*, the opposed outlet surfaces 28*a*, and the convex bottom surface 34*a* can fully contain the stack 14 in addition to a stack 55 that is essentially identical to the stack 14 except that it has a lesser width so that a user of the dispenser 50 can have a choice of sheets of different widths from the dispenser 50. The dispenser 50 could also be made sufficiently long to contain three or more stacks of sheets if that were desired.

The present invention has now been described with reference to two embodiments thereof. It will be apparent to those skilled in the art that many changes can be made in the embodiments described without departing from the scope of the present invention. Thus the scope of the present invention should not be limited to the structure described in this application, but only by structures described by the language the claims and the equivalents of those structures.

I claim:

1. A dispenser for dispensing flexible sheets from a stack of the sheets disposed one on top of another, each sheet having a band of pressure sensitive adhesive coated on one surface adjacent one edge thereof and being free of adhesive coating along a portion adjacent an opposite edge thereof, and the sheets being stacked with the adhesive coating on each successive sheet disposed along alternate opposite sides of the stack and releasably adhering the sheets together to maintain the sheets in the stack, said dispenser comprising:

walls having surfaces defining a cavity adapted to receive the stack, said surfaces including opposed end surfaces having parallel upper ends adapted to be engaged by the opposite sides of the stack with the top sheets in the stack parallel to an adjacent said upper ends, friction surface portions extending generally toward each other from said upper ends, and having spaced distal ends, opposed outlet surfaces at said distal ends defining an opening through said walls between the distal ends of said friction surface portions, said opposed end surfaces being spaced apart a distance less than the distance between the opposite sides of the stack to arc the stack positioned with its sides against the end surfaces and to position the uppermost sheets of the stack along the friction surface portions with the adhesive free portion of the uppermost sheet in the stack projecting through the opening so that by grasping that end portion the uppermost sheet on the stack can be manually pulled through the opening and will carry with it the adhesive free end portion of the sheet beneath it in the stack to which the uppermost sheet is adhered by the adhesive coating, placing that adhesive free end portion in a position where it also may be grasped and pulled to withdraw the next sheet from the stack, said opposed end surfaces diverging slightly from each other toward the upper ends of said end surfaces to cause movement of the end portions of the stack along said end surfaces toward said upper ends in response to forces applied to the stack to sequentially remove sheets from the stack through said opening; and said friction surface portions being shaped to provide means for affording sliding movement of the adhesively joined end portions of the uppermost sheet and the sheet beneath it between the stack and the adjacent friction surface portion, and for making frictional engagement with the adhesive coated end portion of the sheet beneath the uppermost sheet that is sufficient to restrict the movement of the sheet beneath the uppermost sheet between the rest of the stack and the adjacent friction surface portion in response to a force required to peal the uppermost sheet from the sheet beneath it after the uppermost sheet is withdrawn from the dispenser.

2. A dispenser for sheets according to claim 1 wherein said opposed end surfaces are planar.

3. A dispenser for sheets according to claim 2 wherein said end surfaces diverge from each other toward the upper ends of said end surfaces at an angle in the range of about 6 to 18 degrees.

4. A dispenser for sheets according to claim 2 wherein said end surfaces diverge from each other toward the upper ends of said end surfaces at an angle of about 12 degrees.

5. A dispenser for sheets according to claim 1 wherein said walls of said dispenser are included in a unitary structure.

6. A dispenser for sheets according to claim 1 wherein said friction surface portions are generally arcuate and concave, have an axis parallel to said upper ends, and extend toward each other along an aligned arcuate path from said upper ends of said end surfaces.

7. A dispenser for sheets according to claim 1 wherein said friction surface portions are cylindrically arcuate and concave, have an axis parallel to said upper ends, and extend toward each other along an aligned arcuate path from said upper ends of said end surfaces.

8. A dispenser for sheets according to claim 7 wherein said surfaces further include a cylindrically convex bottom surface opposed to and generally uniformly spaced from said cylindrically concave surface portions, and extending between ends of said end surfaces opposite and equally spaced from said upper ends.

9. A dispenser for sheets according to claim 1 wherein said opposed end surfaces, said friction surface portions, and said opposed outlet surface, and a bottom surface opposite and spaced from said friction surface portions extend transversely entirely through said dispenser so that said cavity has opposite end openings, the stack being insertable into said cavity through one of said end openings.

10. A dispenser for sheets according to claim 9 wherein said dispenser has a transverse width less than the width of the stack.

11. A dispenser for sheets according to claim 9 wherein said dispenser has a transverse width greater than the width of the stack.

12. A dispenser for sheets according to claim 9 wherein said dispenser has a transverse width sufficiently greater than the width of the stack to afford positioning a second stack of sheets in the dispenser.

13. A dispenser for sheets according to claim 1 further including means for anchoring said dispenser to a substrate.

14. A dispenser for sheets according to claim 13 wherein said means for anchoring said dispenser to a substrate comprises adhesive foam pads adhered to a base surface of the dispenser and having a coating of pressure.

* * * * *

UNITED STATES PATENT AND TRADEMARK OFFICE

CERTIFICATE OF CORRECTION

PATENT NO. : 4,993,590

DATED : February 19, 1991

INVENTOR(S) : David C. Windorski

It is certified that error appears in the above-identified patent and that said Letters Patent is hereby corrected as shown below:

Abstract, line 20, "to the stack of sequentially" should read --to the stack to sequentially--.

Col. 8, line 12, "pressure." should read --pressure sensitive adhesive on their surfaces opposite the base surface, said coating of pressure sensitive adhesive being covered with a release liner.--

Signed and Sealed this

Nineteenth Day of January, 1993

*Attest:*

DOUGLAS B. COMER

*Attesting Officer*

*Acting Commissioner of Patents and Trademarks*